US007484558B2

(12) United States Patent
Wood

(10) Patent No.: US 7,484,558 B2
(45) Date of Patent: Feb. 3, 2009

(54) LOAD BEARING SUPPORT STRUCTURE FOR RIGS ABOVE A WELLHEAD

(75) Inventor: Jed Morgan Wood, Sylvan Lake (CA)

(73) Assignee: High Arctic Energy Services Limited Partnership, Red Deer, AB (CA)

( * ) Notice: Subject to any disclaimer, the term of this patent is extended or adjusted under 35 U.S.C. 154(b) by 225 days.

(21) Appl. No.: 11/420,428

(22) Filed: May 25, 2006

(65) Prior Publication Data

US 2006/0266511 A1 Nov. 30, 2006

Related U.S. Application Data

(60) Provisional application No. 60/595,024, filed on May 30, 2005.

(51) Int. Cl.
*E21B 15/00* (2006.01)
*F16B 11/40* (2006.01)

(52) U.S. Cl. ..... 166/96.1; 166/75.14; 248/166; 248/163.1; 248/436

(58) Field of Classification Search ..... 166/96.1, 166/75.14, 77.4, 75.11; 248/166, 163.1, 248/163.2, 436
See application file for complete search history.

(56) References Cited

U.S. PATENT DOCUMENTS

| | | | | |
|---|---|---|---|---|
| 4,290,495 | A * | 9/1981 | Elliston | 175/85 |
| 5,090,486 | A * | 2/1992 | Jones | 173/26 |
| 5,224,716 | A | 6/1996 | Wachholz | |
| 5,524,716 | A | 6/1996 | Wachholz | |
| 6,234,253 | B1 * | 5/2001 | Dallas | 166/377 |

* cited by examiner

*Primary Examiner*—David J Bagnell
*Assistant Examiner*—Brad Harcourt
(74) *Attorney, Agent, or Firm*—Sean W Goodwin

(57) ABSTRACT

A support structure for a rig above a wellhead, such as a snubbing unit, is provided which directs loads from the rig into the ground to minimize stress on the wellhead components. The support structure generally comprises a support plate to be secured onto a wellhead and onto which the rig is secured and at least three ground engaging members distributed around and connected to the support plate, with the ground engaging members accepting the load placed on the support plate. The ground engaging members can be independently vertically adjustable, such as jack stands, for distributing the load between the ground engaging members. The support structure can also be adapted to be movable between a compact shipping position and a deployed operating position.

26 Claims, 8 Drawing Sheets

LOAD BEARING SUPPORT STRUCTURE FOR RIGS ABOVE A WELLHEAD

CROSS REFERENCE TO RELATED APPLICATION

This application is a U.S. Patent application claiming priority of U.S. Provisional Patent application Ser. No. 60/595,024, filed May 30, 2005, the entirety of which is incorporated herein by reference.

FIELD OF THE INVENTION

The invention relates to rigs above a wellhead, such as snubbing units for manipulating tubing in and out of a well under pressure. More particularly, specific arrangements of the load-bearing support structure for rigs above a wellhead minimize stress on the wellhead components.

BACKGROUND OF THE INVENTION

It is well known to attach a variety of rigs such as hydraulically operated rigs above a wellhead. For example, snubbing units are known in the oil and gas industry for facilitating access to a well which is under pressure including, for example, well operations such as well completions. A snubbing unit includes structure and equipment above a wellhead for manipulating tubular components such as pipe, tubing, and bottom hole assemblies (BHA) in and out of a well while controlling the well under pressure. Wellhead components are not conventionally equipped to deal with the manipulation of tubular components therethrough. Therefore, additional equipment in cooperation with the snubbing unit provides additional sealing and physical handling components which are required to handle tubular components, which may be either heavy tubular components which tend to fall into the well, termed "pipe heavy", or which can be upwardly energized for ejection from the well under pressure, termed "pipe light".

Snubbing units are either rig-mounted or stand alone units. Generally, a stand alone snubbing unit is supported on a structure that is in turn supported from the wellhead. A wellhead comprises structure which provides the interface between fluids in the well, the surface equipment and the environment. Wellhead integrity is critical. Wellheads include blowout preventors (BOPs) and other fluid-control devices, the success of which depends on the integrity of the wellhead. Conventionally, the snubbing structure places significant loading on the wellhead which is not related to its primary task of containing well fluids. Loading includes vertical gravity loads, working loads and lateral wind loading.

Threaded wellhead connections, such as casing bowls that are screwed to the casing, are particularly vulnerable to bending loads imposed on the wellhead. Additional aspects that contribute to loading on the wellhead include difficulties with proper leveling of the snubbing unit.

There is, therefore, a need in the art for an improved load bearing support for rigs above a wellhead such as a snubbing unit.

SUMMARY OF THE INVENTION

A support structure for a rig above a wellhead, such as a snubbing unit, is provided which accepts loads from the rig and directs the loads into the ground which would otherwise be directed to and supported by the wellhead. The support structure thereby minimizes stress on the wellhead components, including those particularly vulnerable to bending loads imposed by the rig, such as threaded wellhead connections.

The support structure generally comprises a support plate to be secured onto a wellhead and onto which a rig is secured, and at least three ground engaging members distributed around the support plate and connected thereto. The ground engaging members accept the load placed on the support plate and direct the load into the ground to thereby reduce the load of the rig on the wellhead. The support plate also forms a passageway for receiving tubular members therethrough between the rig and the wellhead.

Preferably, each of the ground engaging members is independently vertically adjustable for distributing the load between the ground engaging members. In one embodiment, the ground engaging members are jack stands connected the support plate by outrigger arms. The jack stands can include a vertical adjustment post connected between the jack and the outrigger arm for additional vertical positioning. Each of the outrigger arms and the jack stands can also be pivotally connected so as to enable the support structure to be moved between a compact shipping position and a deployed operating position.

The structure can be employed as an overall system of a snubbing unit, the support structure, and optionally guylines between the snubbing unit and the support structure.

BRIEF DESCRIPTION OF THE DRAWINGS

In drawings which are intended to illustrate embodiments of the invention and which are not intended to limit the scope of the invention.

DESCRIPTION OF THE PREFERRED EMBODIMENTS

Figure 1:
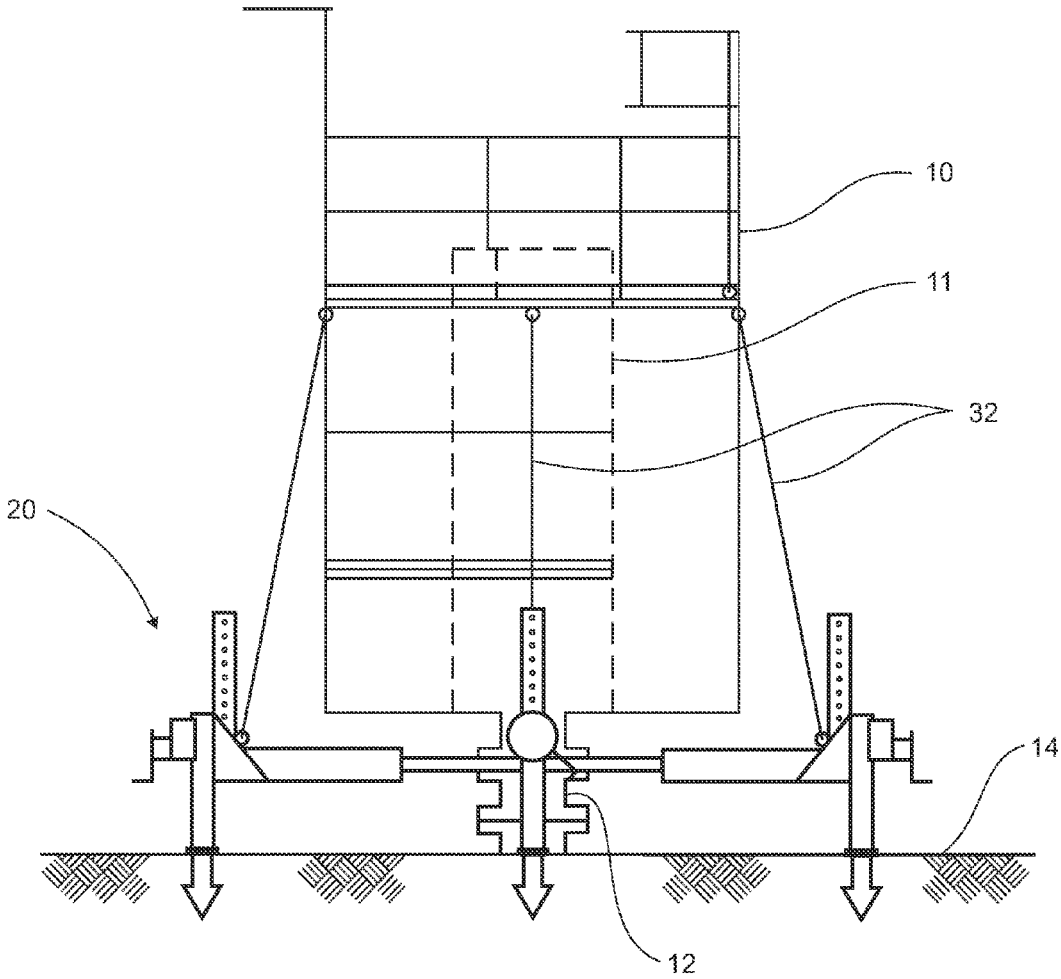
FIG. 1 is an elevational view of one embodiment of a load bearing support structure in accordance with the present invention, with the support structure in use with a snubbing unit.

With reference to FIG. 1, a stand-alone snubbing unit 10 with snubbing components 11 mounted therein is mounted to a wellhead 12 extending from the ground 14 and including standard wellhead components, a casing bowl being shown. The snubbing unit 10 is supported on a load bearing apparatus or support structure 20, with the load being generally distributed into the ground 14 as indicated by the arrows.

The support structure 20 accepts loads from the snubbing unit 10, or other rigs above a wellhead, the load being previously directed to and supported by the wellhead 12. The snubbing unit 10 is secured to the support structure 20 and the support structure 20 is secured to the wellhead 12.

Figure 2:
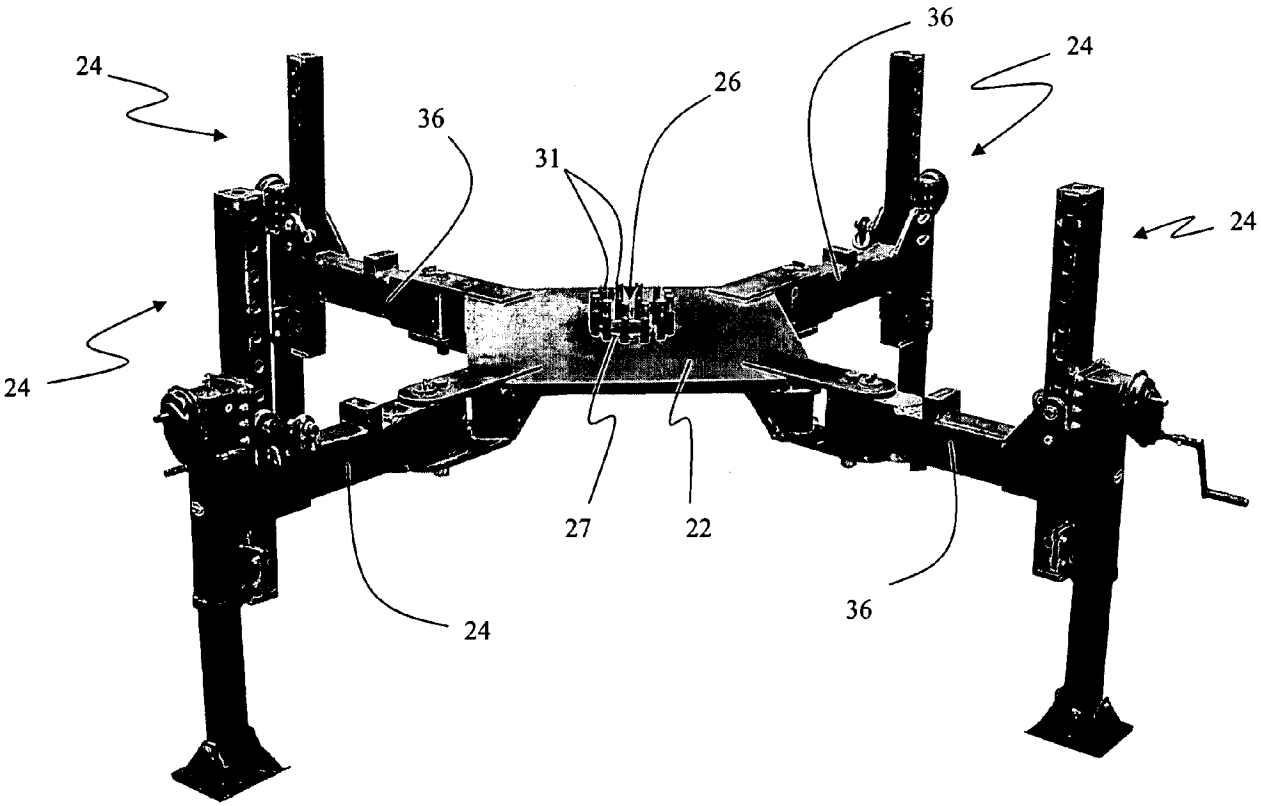
FIG. 2 is a perspective view of the load bearing support structure of FIG. 1.

As shown in FIG. 2, the support structure 20 comprises a frame or support plate 22 and three or more ground engaging members, generally designated as 24, distributed around and connected to the support plate 22. The support plate 22 is adapted to be secured to each of the snubbing unit and the wellhead and forms a passageway 26 for receiving tubular members therethrough.

Figure 6A:
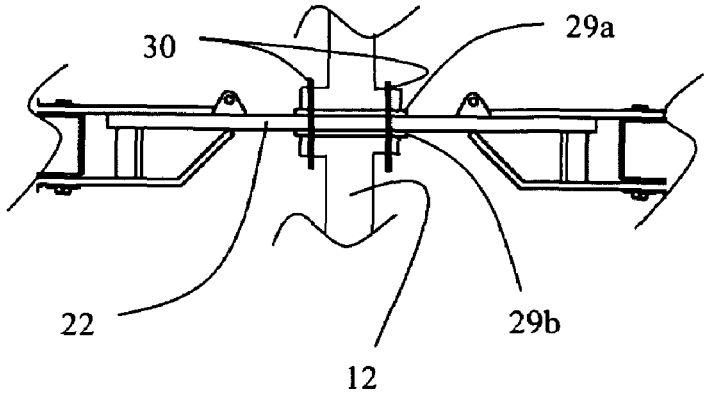
FIG. 6*a* is a partial side elevational view of a load bearing support structure according to another embodiment of the present invention having an alternate flange detail and shown coupled to a snubbing unit and a wellhead.
Figure 6B:
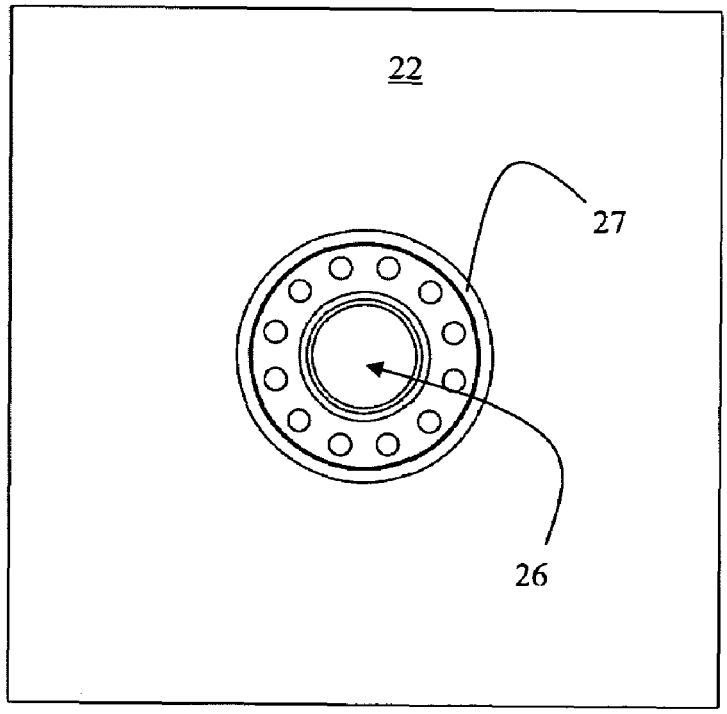
FIG. 6*b* is a top plan view of the support plate and flange of FIG. 6*b*.

With further reference to FIGS. 6*a* and 6*b*, the support plate 22 can include a flange 27 securely set into the passageway 26. The flange 27 forms an upper face 29*a* for coupling to the snubbing unit 10 thereabove and a lower face 29*b* for coupling to a wellhead 12 below. The lower face 29*b* can be coupled directly or indirectly, such as via a blowout preventor located intermediate the support plate 22 and a casing bowl of the wellhead. The upper and lower flange faces 29*a*, 29*b* can be coupled to the adjacent structure such as by bolts 30 or studs 31 (FIG. 2) or other suitable means. The flange 27 can be any suitable flange, such as a conventional American Petroleum Institute (API) approved flange, and can be securely set into the plate by welding the flange to a beveled edge of the support plate or other means as would be apparent to one skilled in the art.

Generally, the ground engaging members 24 accept load placed on the support plate 22 by the snubbing unit 10 and are preferably vertically adjustable for engaging the ground 14 and distributing the load between the ground engaging members 24.

In one embodiment, the support structure 20 takes vertical loads off the wellhead 12, and is particularly useful in protecting threaded wellheads to minimize the likelihood of overloading the threaded wellhead connection. For example, in the embodiment shown having four ground engaging members 24 extending from four corners of a square support plate 22, the support structure 20 supports a total vertical capacity of 30,000 lbs equally distributed over the support structure 20 at each of the four corners. The allowable stress values were determined using the American Institute of Steel Construction (AISC) Allowable Stress Design handbook.

In another embodiment, and as seen in FIG. 1, the supporting structure 20 also laterally stabilizes the snubbing unit 10 such as by with guyline 32 connected between the snubbing unit 10 and the support structure 20, rather than the prior art approach of guying from the snubbing unit to external anchors. Thus, a freestanding system of snubbing unit 10 and support structure 20 results.

Figure 3:
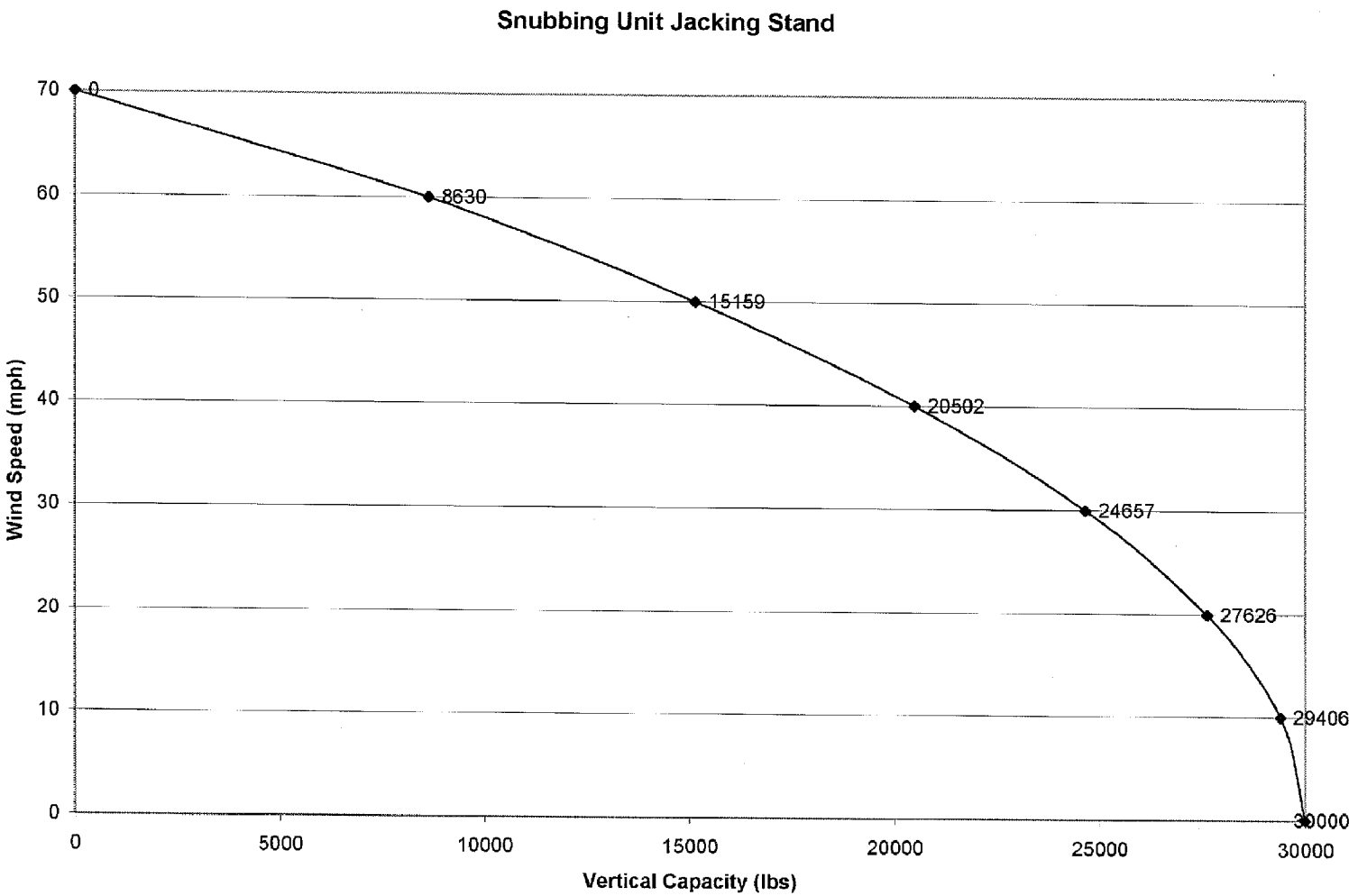
FIG. 3 is a graphical analysis of the effect of the relationship between wind speed and the vertical capacity of a load bearing support structure in accordance with the present invention.
Figure 4A:
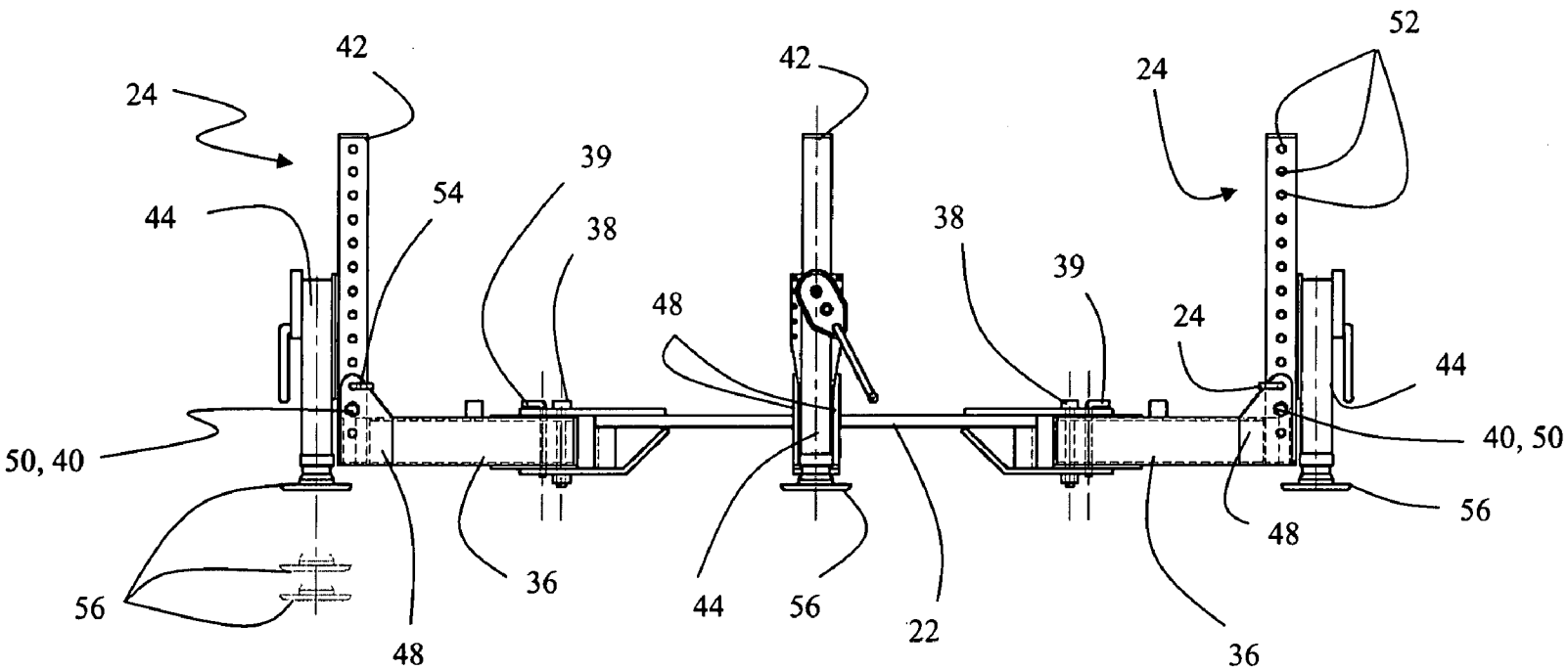
FIG. 4*a* is an elevational view of the load bearing support structure of FIG. 2 with the feet in a non-extended position, and showing extendable positioning of the feet.
Figure 4B:
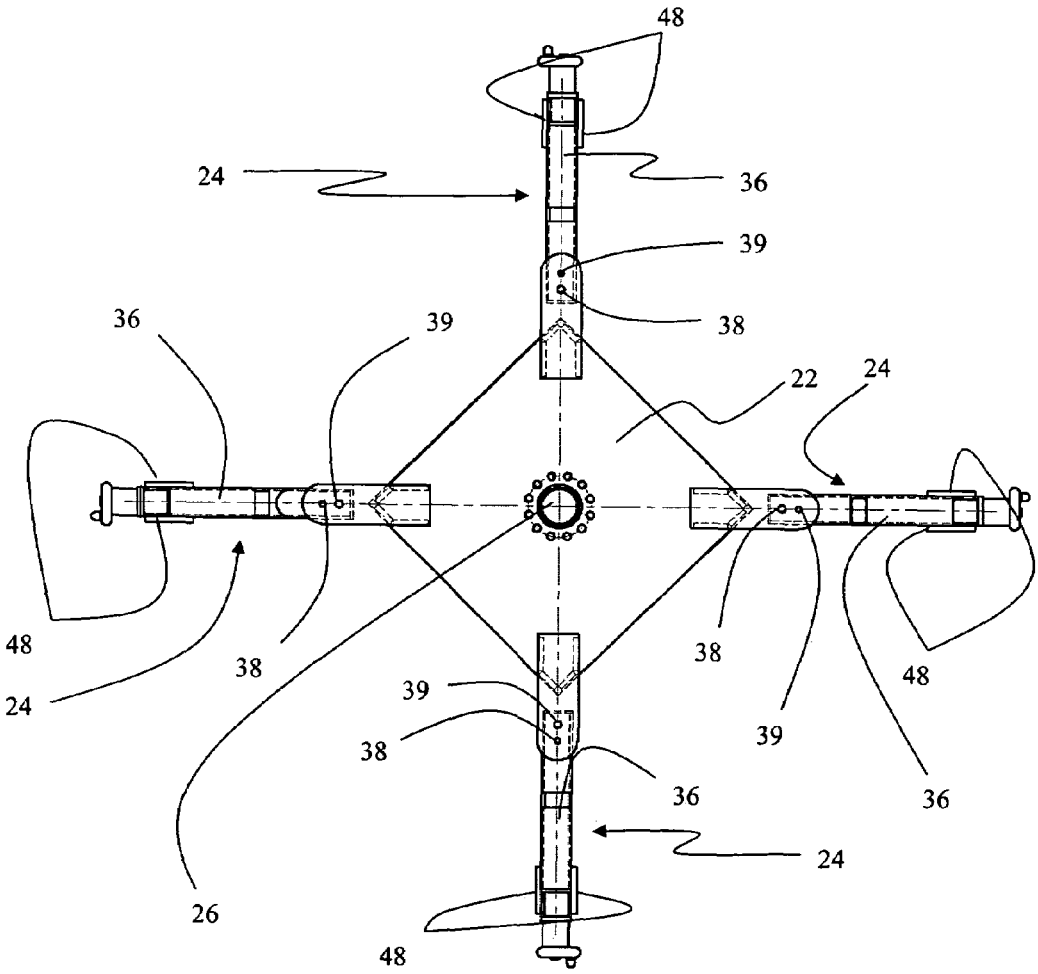
FIG. 4*b* is a top plan view of a load bearing support structure of FIG. 2.

With reference to FIG. 3, an analysis was performed to relate the wind speed and force to the stabilizing capacity of the support structure 20 in use as generally shown in FIG. 1. A graphical representation demonstrates the relationship between the allowable wind speed and the maximum vertical capacity for the support structure 20. The allowable stress values for the design were determined using the AISC handbook. The general design assumptions include: the wellhead connection 12 that the snubbing unit 10 is sitting on during operation does not move with applied vertical loading; any horizontal loading from the wind is resisted by the wellhead 12 rather than the snubbing frame 10; the reaction loads at the ground 14 by the ground engaging members 24 are equally distributed, and the ground capacity is not exceeded, and the geometry for the guylines 32 and the wind loading is specific to the snubbing unit 10 analyzed. If the location of the supporting structure 20, relative to the snubbing unit 10, or the guyline 32 angle changes significantly, the capacity of the system would be reviewed.

A means of monitoring the loading on the ground engaging members 24 is recommended, such as pressure pads, to ensure that uneven loading is not applied to the wellhead 12. Overall, the support structure is designed to be suitable for the anticipated loads, wellhead connections, and other parameters, as would be apparent to one skilled in the art.

With reference to FIG. 2 and further reference to FIGS. 4*a*, 4*b*, 5*a* and 5*b*, in one embodiment, the ground engaging members 24 are jack stands radially outwardly spaced from the support plate 22 by outrigger arms 36 connected therebetween. The outrigger arms 36 are pivotally connected to the support plate 22 so as to be deployed between a compact shipping position (FIGS. 5*a*, 5*b*) adjacent the support plate 22 and a deployed operating position (FIGS. 4*a*, 4*b*) extending radially to maximize the footprint of the support structure 20. As shown, the outrigger arms 36 are connected about a vertical pivot 38 for movement in the horizontal plane. A pin 39 spaced apart from the vertical pivot 38 and extending through the outrigger arms 36 and the support plate 22 locks the outrigger arms 36 in the deployed position.

Figure 5A:
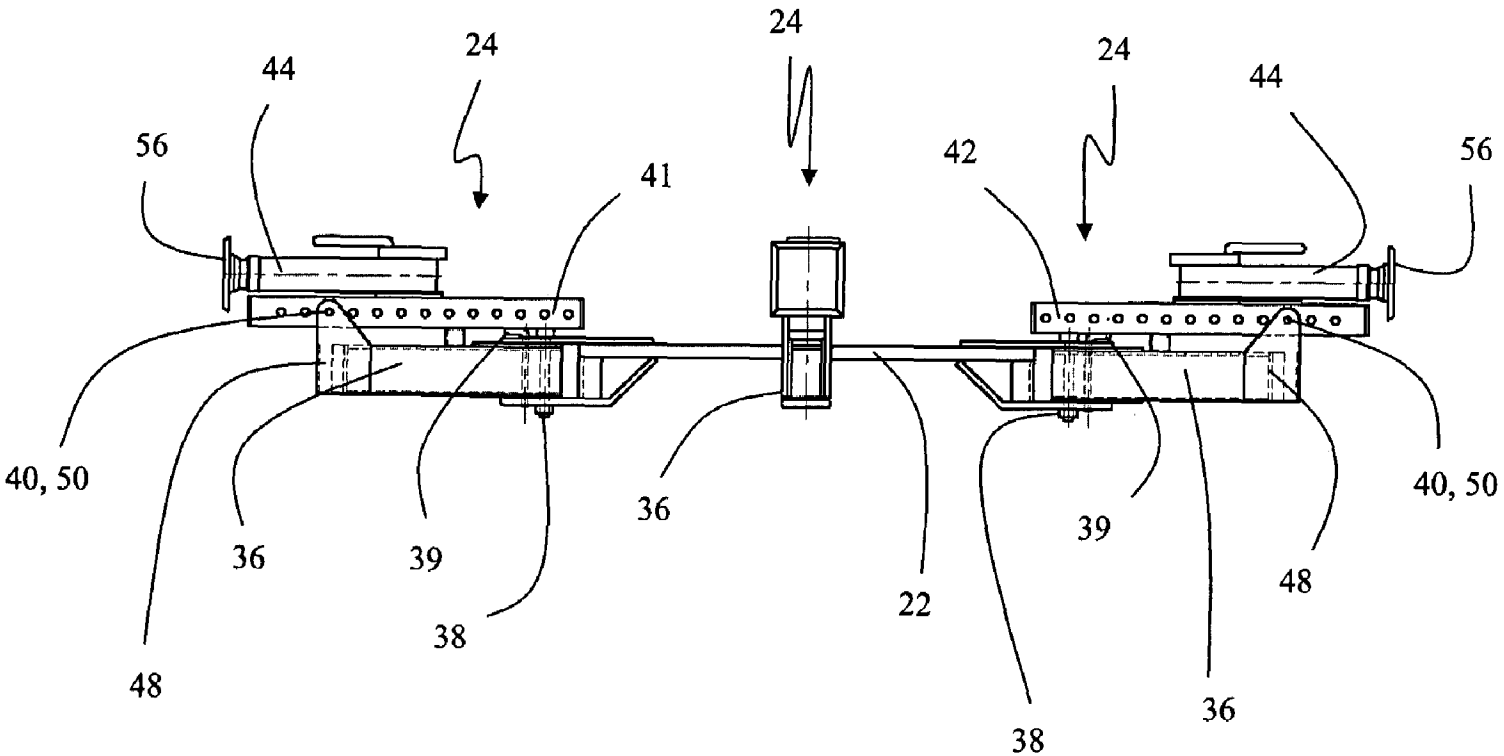
FIG. 5*a* corresponds to FIG. 4*a* and with the load bearing support structure folded into a compact shipping position.
Figure 5B:
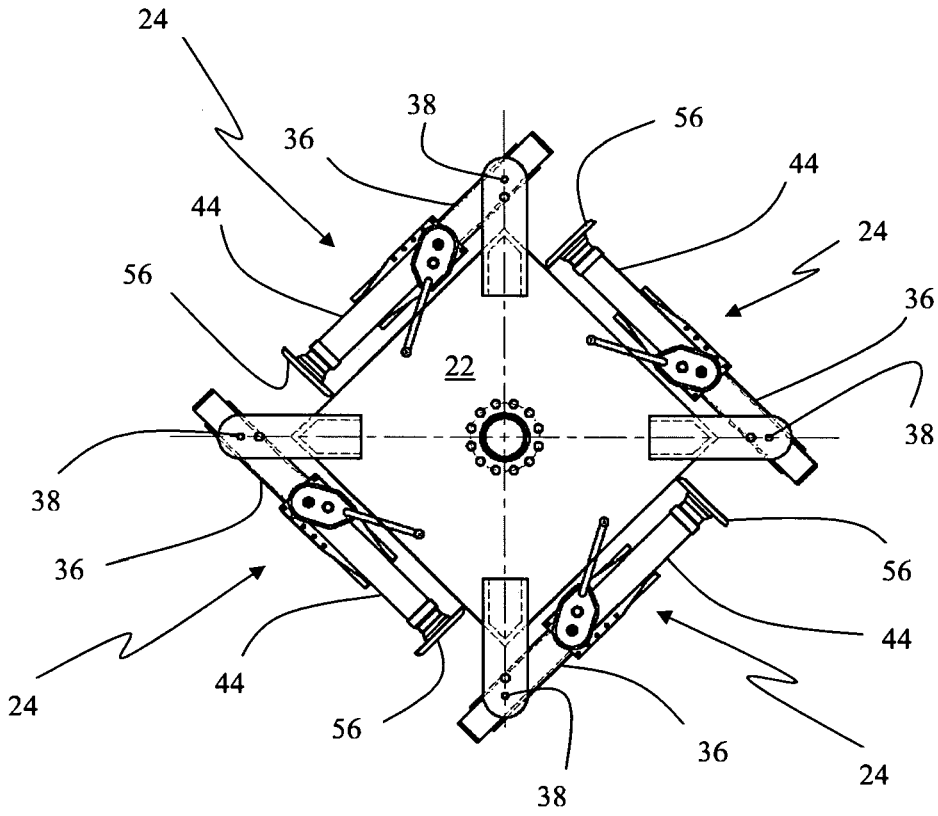
FIG. 5*b* corresponds to FIG. 4*b* and with the load bearing support structure folded into a compact shipping position.

The jack stands 24 are connected about a horizontal pivot 40 to the outrigger arms 36 to be pivotally movable between a horizontal shipping position (FIG. 5*a*) adjacent the outrigger arms 36 and a vertical jacking position (FIG. 5*a*).

Each jack stand 24 comprises a manual vertical adjustment post 42 and a jack 44. As shown, the jack is a crank-operated jack; however the jack can be any suitable jack, including a hydraulic jack. The adjustment post 42 permits manual stepwise positioning of the jack 44 relative to the outrigger arm 36 and in use for gross positioning of the jack 44 adjacent the ground 14 or other intermediate support surface. The distal end of the outrigger arm 36 includes a pair of gussets 48 straddling the adjustment post 32. A fastening member 50 such as a bolt or a pin extending through the gusset 48 and one of a plurality of spaced adjustment holes 52, 52, etc. in the vertical adjustment post 42 enables the gross vertical positioning of the jack 44, as well as provides the horizontal pivot 40. Further, a combination of the fastening member 50 and a locking member 54 such as a pin extending through another adjustment hole and the gusset 48 locks the jack 44 and adjustment post 42 in the vertical jacking position.

Best shown in FIG. 2, once in position, the jacks 44 are actuated to extend feet 56 to the ground 14 and accept load placed into the support plate 22.

Although preferred embodiments of the invention have been described in some detail herein, those skilled in the art will recognize that various substitutions and modifications of the invention may be made without departing from the scope of the invention.

The embodiment(s) of the invention in which an exclusive property or privilege is claimed are defined as follows:

1. A support structure for supporting loads from a rig above a wellhead having a bore under pressure, the wellhead extending from the ground, the support structure comprising:

a support plate having a flanged passageway therethrough, with an upper flange face adapted for securely supporting the rig thereon, and a lower flange face adapted to be secured to the wellhead therebelow, the passageway adapted for receiving tubular members therethrough between the rig and the bore of the wellhead under pressure; and three or more ground engaging members distributed around the support plate and connected thereto, wherein the loads placed on the upper flange face are directed to the support plate and distributed to the ground engaging members to thereby reduce the loads directed to the wellhead.

2. The support structure of claim 1 further comprising:

means of monitoring load on the ground engaging members.

3. The support structure of claim 1 wherein the ground engaging members are independently vertically adjustable for distributing the load between the ground engaging members.

4. The support structure of claim 1 wherein each ground engaging member is spaced from the support plate by an outrigger arm.

5. The support structure of claim 1 wherein the ground engaging members are jack stands.

6. The support structure of claim 1 wherein the ground engaging members are jack stands and wherein each jack stand is spaced from the support plate by an outrigger arm.

7. The support structure of claim 6 wherein each jack stand comprises:

a jack having a vertically extendible foot; and a vertical adjustment post attached to the jack, the vertical adjustment post adapted for stepwise vertical adjustment of the jack stand relative to the outrigger arm.

8. The support structure of claim 7 wherein the vertical adjustment post is adapted by comprising:

a plurality of spaced adjustment holes for selectively receiving a fastening member extending through one of the adjustment holes and a corresponding hole in the outrigger arm.

9. The support structure of claim 6 wherein each jack stand is pivotally connected to the outrigger arm for pivoting movement between a horizontal shipping position adjacent the outrigger arm and a vertical jacking position.

10. The support structure of claim 9 further comprising:

a lock for releasably locking the jack stand in the vertical jacking position.

11. The support structure of claim 10 wherein the lock comprises a locking member extending through corresponding holes in the outrigger arm and the jack stand and spaced from the pivotal connection.

12. The support structure of claim 6 wherein each outrigger arm is pivotally connected to support plate for movement between a compact shipping position adjacent the support plate and a deployed radially extended position.

13. The support structure of claim 12 wherein each outrigger arm is pivotally connected about a vertical pivot for movement in the horizontal plane.

14. The support structure of claim 1 wherein the support plate is substantially square and having four corners, the support structure having four ground engaging members extending from the corners of the support plate.

15. The support structure of claim 1 wherein the rig is a snubbing unit which generates snubbing loads.

16. The support structure of claim 1 wherein the loads from the rig are vertical loads.

17. The support structure of claim 1 wherein the loads from the rig are bending loads.

18. The support structure of claim 1 wherein the loads from the rig are both vertical and bending loads.

19. A support structure for supporting loads from a snubbing unit above a wellhead having a bore under pressure, the wellhead extending from the ground, the support structure comprising:

a support plate having a flanged passageway therethrough, with an upper flange face adapted for securely supporting the snubbing unit thereon, and a lower flange face adapted to be secured to the wellhead therebelow, the passageway adapted for receiving tubular members therethrough between the snubbing unit and the wellhead under pressure; and three or more jack stands radially outwardly spaced from and distributed around the support plate, each jack stand connected to the support plate by an outrigger arm, each jack stand being pivotally connected to the outrigger arm for pivoting movement between a horizontal shipping position adjacent the outrigger arm and a vertical jacking position, each outrigger arm pivotally connected to the support plate for movement between a compact shipping position adjacent the support plate and a deployed radially extended position;

wherein the jack stands accept the loads placed on the support plate by the snubbing unit and directs the loads into the ground to thereby reduce the loads directed to the wellhead.

20. The support structure of claim 19 wherein each jack stand comprises:

a vertical adjustment post for stepwise vertical adjustment of the jack stand relative to the outrigger arm, the vertical adjustment post comprising a plurality of spaced adjustment holes for selectively receiving a fastening member extending through one of the adjustment holes and a corresponding hole in the outrigger arm.

21. A stand alone snubbing unit system comprising:

a snubbing unit; and a support structure for supporting loads from the snubbing unit above a wellhead having a bore under pressure, the wellhead extending from the ground, the support structure comprising, a support plate connected to the snubbing unit for securely supporting the loads from the snubbing unit thereon, the support plate having a flanged passageway therethrough, with an upper flange face adapted for securing the snubbing unit thereon, and a lower flange face adapted to be secured to the wellhead therebelow, the flanged passageway adapted for receiving tubular members therethrough between the snubbing unit and the bore of the wellhead under pressure; and three or more ground engaging members distributed around the support plate and connected thereto, wherein the loads placed on the upper flange face are directed to the support plate and distributed to the ground engaging members to thereby reduce the loads directed to the wellhead.

22. The snubbing unit system of claim 21 further comprising:

means of monitoring load on ground engaging members.

23. The snubbing unit system of claim 21 wherein the ground engaging members are independently vertically adjustable for distributing the load between the ground engaging members.

24. The stand alone snubbing unit of claim 21 wherein the loads from the snubbing unit are vertical loads.

25. The stand alone snubbing unit of claim 21 wherein the loads from the snubbing unit are bending loads.

26. The stand alone snubbing unit of claim 21 wherein the loads from the snubbing unit are both vertical and bending loads.

* * * * *